United States Patent [19]

Hermann

[11] 4,004,307

[45] Jan. 25, 1977

[54] COLLAPSIBLE BOAT FRAME

[75] Inventor: Franz Hermann, Aisingerwies, Germany

[73] Assignee: Klepper-Werke, Rosenheim, Germany

[22] Filed: Mar. 8, 1976

[21] Appl. No.: 664,879

Related U.S. Application Data

[63] Continuation of Ser. No. 589,666, June 24, 1975, abandoned.

[30] Foreign Application Priority Data

July 8, 1974 Germany ..... 2432641

[52] U.S. Cl. ..... 9/2 C; 9/2 F

[51] Int. Cl.[2] ..... B63B 7/04

[58] Field of Search ..... 9/2 R, 2 F, 2 C, 2 S, 9/6.5

[56] References Cited

FOREIGN PATENTS OR APPLICATIONS

| | | | |
|---|---|---|---|
| 613,674 | 11/1926 | France | 9/2 C |
| 648,386 | 7/1937 | Germany | 9/2 C |
| 844,197 | 8/1960 | United Kingdom | 9/2 C |
| 245,591 | 4/1969 | U.S.S.R. | 9/2 R |

*Primary Examiner*—George E. A. Halvosa
*Assistant Examiner*—Charles E. Frankfort
*Attorney, Agent, or Firm*—Hans Berman

[57] ABSTRACT

The fore and aft sections of a folding boat frame each have a post located in the longitudinal median plane of the section, and two sets of elongated stringers extending away from the post on respective sides of the median plane. Each stringer has a first portion attached to the frame and a second portion hinged to the first for folding the two portions on each other. Each set includes a bottom stringer having a major longitudinal face. The first stringer portions are pivotally connected to a rib frame which may be folded about an axis in the median plane toward and away from the plane. The bottom stringers are fastened to the rib frame in such a manner that they move angularly relative to each other from a position in which their major faces converge toward the median plane at an obtuse angle to a position in which the angle is much smaller and acute when the rib frame is folded. The second stringer portions carry releasable coupling elements for engagement with corresponding elements on the other section, whereby the sections may be assembled to constitute the boat frame.

12 Claims, 10 Drawing Figures

COLLAPSIBLE BOAT FRAME

This is a continuation, of application Ser. No. 589,666, filed June 24, 1975 and now abandoned.

This invention relates to folding boats of the type in which a skin or shell of pliable material covers a collapsible frame of more rigid elements in the operative condition of the boat, and particularly to a collapsible frame for a folding boat.

The frames employed heretofore are assembled from a relatively large number of parts, and the parts must be disassembled after use of the boat for convenient transportation. The assembly and disassembly operations are performed without difficulty after some experience, but the novice has to spend substantial time in properly connecting the parts, and the multitude of parts requires a relatively long assembly period even in the hands of an experienced boater.

It is the primary object of this invention to provide a collapsible boat frame many of whose parts are permanently assembled and still capable of being collapsed into a small package for transportation, the contents of the package being readily expanded into two sections of the boat frame for insertion in the skin or shell which normally cannot receive a fully assembled frame.

With this object in view, and others as will presently become apparent, the invention provides a collapsible frame whose fore and aft sections are elongated and each have a longitudinal median plane. Each section includes a post or stem located in the median plane and two sets of elongated stringers extending away from the post on respective opposite sides of the plane. Each stringer has a first longitudinal portion movably attached to the post and a second portion hingedly attached to the first portion for movement toward and away from a folded position in which the two portions are elongated in a common direction and are juxtaposed transversely to the common direction. Each set includes a bottom stringer having a major longitudinal face.

Each section further includes a rib frame having two portions hingedly connected for movement about a pivot aixs substantially parallel to the median plane between an operative position in which the rib frame portions extend from the median plane in opposite respective directions, and an inoperative position in which the rib frame portions are adjacent the median plane. Pivots connect the rib frame with all first stringer portions for relative pivoting movement. More specifically, first and second pivots connect the rib frame portions to the first portions of the two bottom stringers respectively and cause angular movement of the first bottom stringer portions relative to each other about their longitudinal axes in response to movement of the rib frame portions. The major faces of the first bottom stringer portions converge toward the median plane at a predetermined angle in the operative position of the rib frame portions, and at a smaller angle in the inoperative position of the rib frame portions.

A coupling element on the second portion of each stringer is provided for releasably coupling the second portion to the second portion of the corresponding stringer in the other frame section. The median planes of the two sections substantially coincide when the respective stringers are coupled.

Other features and many of the attendant advantages of this invention will readily be appreciated as the same becomes better understood from the following detailed description of a preferred embodiment when considered in connection with the appended drawing in which.

Figure 1:
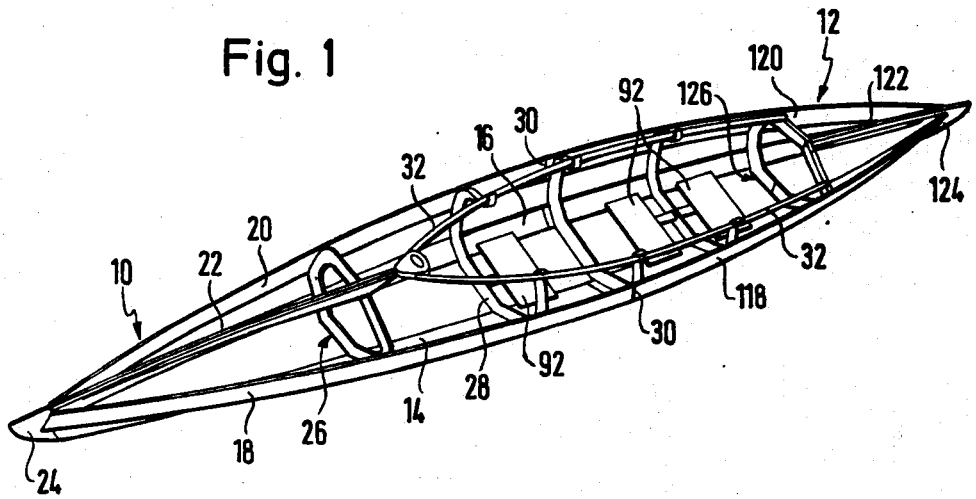
FIG. 1 is a perspective view of an assembled boat frame of the invention.

Referring now to the drawing in detail, and initially to FIG. 1, there is seen the collapsible frame of a folding boat in the fully assembled condition which is not normally reached until the frame is received in its skin or shell of pliable, plastic-coated fabric, not shown.

The frame consists mainly of a fore-section 10 and an aft-section 12 which are coupled to each other in a conventional manner, not shown in detail in FIG. 1, for abutting engagement along a seam 30. The two sections 10, 12 are symmetrical relative to respective longitudinal median planes which coincide, or practically coincide, in the assembled frame. The two sections differ from each other almost exclusively in dimensions of corresponding parts.

The fore-section 10 has a plate-shaped post or stem 24 located in the median plane and five elongated stringers movably attached to the post 24 and extending away from the same. They include a bottom stringer 14 and a side stringer 18 on the port side, and a similar set of a bottom stringer 16 and a side stringer 20 on the starboard side. The stringers 14, 16, 18, 20 are strips of plywood having each two relatively wide longitudinal major faces connected by narrow minor faces. A deck stringer 22 is approximately bar-shaped. The bottom and side stringers are permenantly connected by a rib frame 26.

The aft-section elements are provided with reference numerals differing from those of the corresponding fore-section elements by 100. The aft-section thus has a post or stem 124, five stringers 114, 116, 118, 120, 122 permanently attached to the post 124, and a rib frame 126 permanently connecting the stringers 114, 116, 118, 120.

In addition to the permanently assembled elements of the sections 10, 12, the frame includes a few small parts of which three U-shaped ribs 28, a flexible deck sill 32, and three seat boards 92 are shown in FIG. 1.

Figure 2:
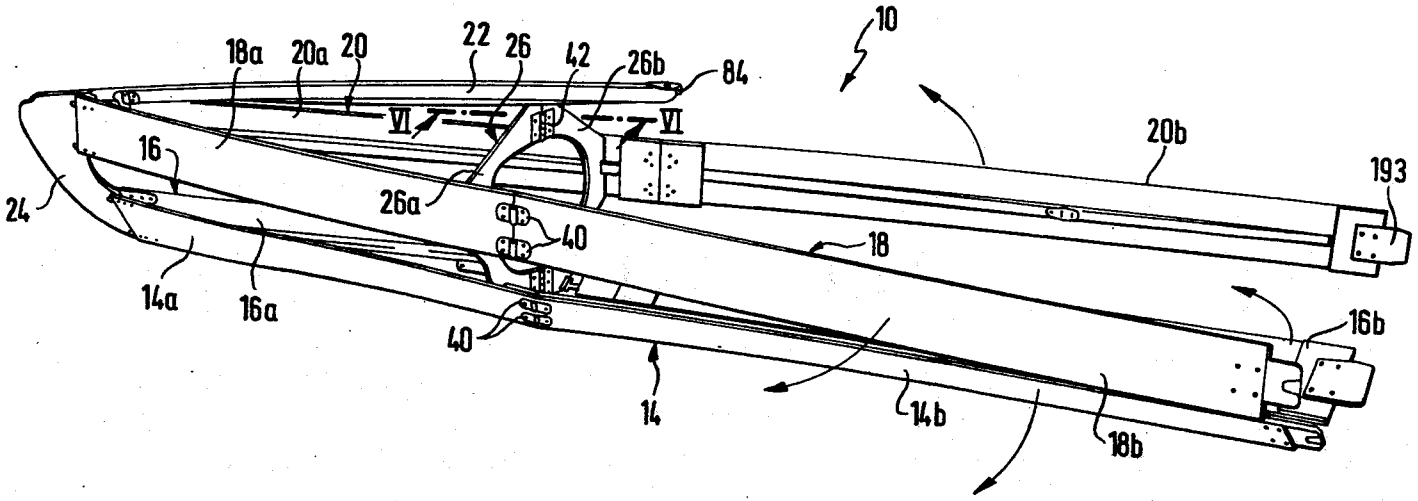
FIG. 2 shows the fore section of the frame ready to be inserted in the pliable skin or shell in a perspective side view.

FIG. 2 shows the fore-section 10 ready to be inserted into the pliable boat shell and thereafter to be coupled to the aft section. Each of the stringers 14, 16, 18, 20 consists of two longitudinal portions. The first stringer portions 14*a*, 16*a*, 18*a*, 20*a* are permanently fastened to the post 24 in such a manner as to permit some horizontal angular movement of the first stringer portions on the post 24. The second portions 14*b*, 16*b*, 18*b*, 20*b* of the bottom and side stringers are fastened to the first stringer portion by hinges 40. The rib frame 26 is split in the median plane of symmetry of the section into halves 26*a*, 26*b* connected by two hinges 42 of which only one is seen in FIG. 2. The deck stringer 22 is a rigid structural unit carrying a sill fitting 84.

Except for details associated with the deck stringer 122, the aft section is so closely similar to the structure shown in FIG. 2 as not to require separate description.

Figure 3:
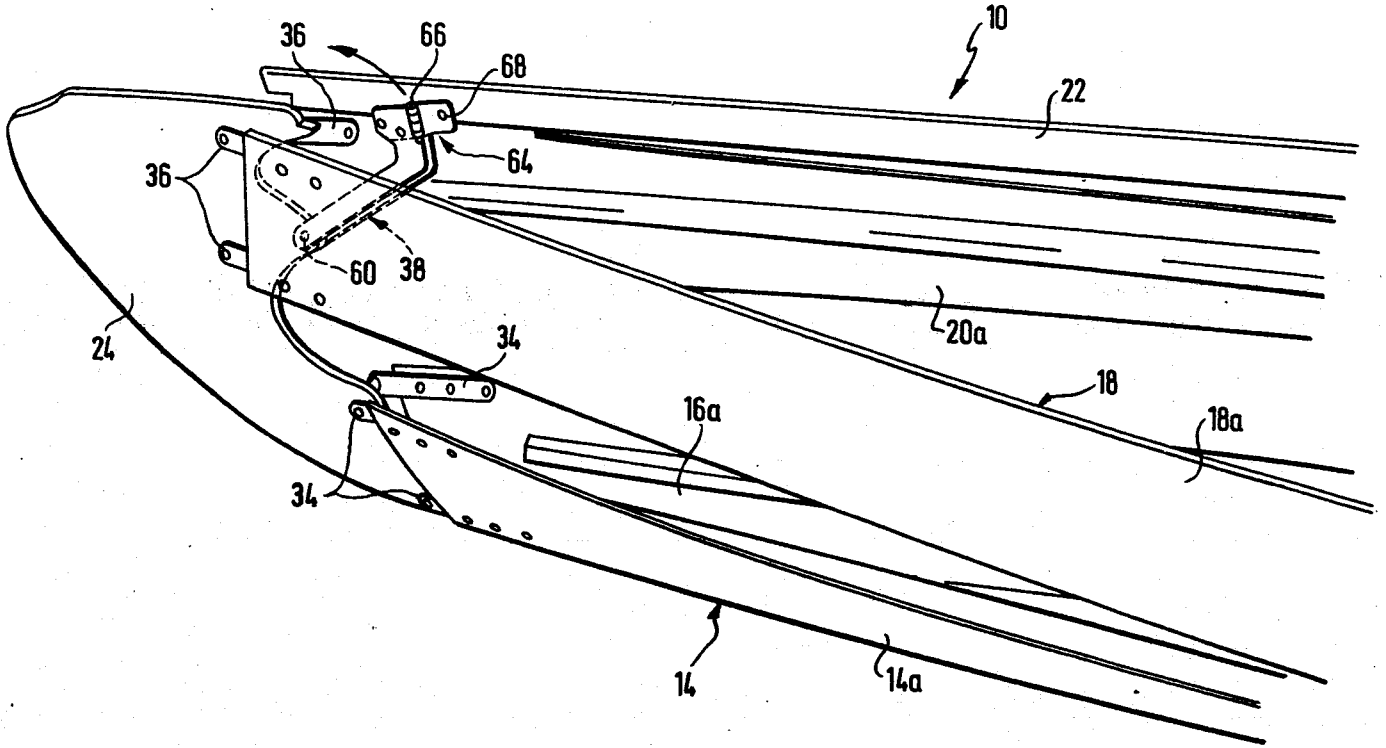
FIG. 3 illustrates the bow portion of the frame immediately before reaching the condition shown in FIG. 2 in an analogous view on a larger scale.
Figure 4:
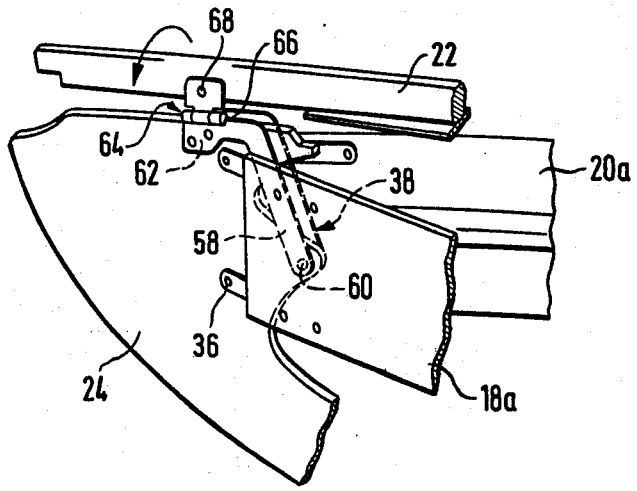
FIGS. 4 and 5 are fragmengary, side-elevational views of the device of FIG. 3 during successive stages of frame disassembly.
Figure 5:
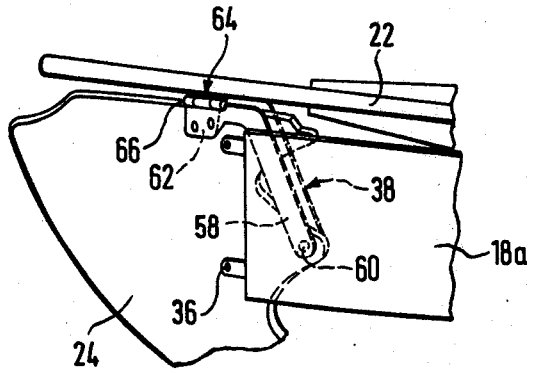

As is shown in greater detail in FIGS. 3, 4, and 5, the bottom stringer portions 14*a*, 16*a* are fastened to the post 24 by lugs 34, 36 and by shoulder rivets received in openings of the lugs 34, 36 with the clearance necessary for the desired limited mobility of the linkages. The linkage 38 which connects one longitudinal end of the deck stringer 22 to the post 24 includes two flat, angular linking bars 58 whose longer legs are held in movable contact with the two major faces of the plate-shaped post 24 by a pivot pin 60 perpendicular to the median plane of frame symmetry. The shorter legs of the links 58 are fastened to a leaf 62 of a hinge 64 whose other leaf is attached to the deck stringer 22. The hinge pin 66 connecting the leaves is parallel to and at least closely adjacent the plane of symmetry in all angular positions of the links 58 on the pin 60.

In the operative condition of the frame, as shown in FIG. 2, the deck stringer 22 projects aft beyond the first stringer portions 14*a*, 16*a*, 18*a*, 20*a*. For collapsing each section 10, 12 to its smallest bulk, the second sections 14*b*, 16*b*, 18*b*, 20*b* are swung foreward on the hinges 40 until they are approximately parallel, or at least extend in a common direction of elongation with the corresponding first portions and are transversely juxtaposed to the same. The first stringer portions are of equal length, as are the second stringer portions. The overall length of the package is thus determined by the longer of the two stringer portions when the deck stringer is shifted forward from the position of FIG. 2 on the linkage 38 through the position of FIG. 3 and further into the position of FIG. 4. The operative height of the deck stringer in the median plane of symmetry is greater than its width at right angles to the plane. The overall size of the collapsed section 10 is thus further reduced by turning the deck stringer 22 90° on the hinge pin 66 into the position seen in FIG. 5.

Figure 6:
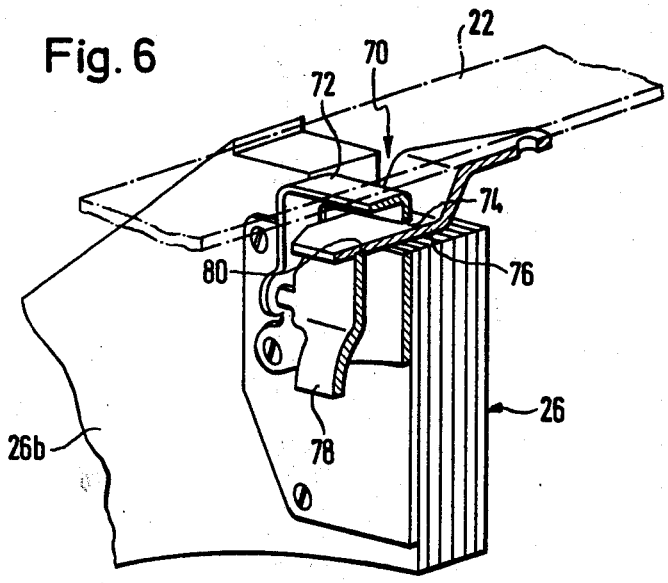
FIG. 6 shows elements of the assembled boat frame in a perspective view, partly in side-elevational section on the line VI—VI in FIG. 2.

When in the operative position shown in FIGS. 1 and 2, the deck stringer 22 is fastened to the rib frame 26 by a coupling assembly 70 illustrated in FIG. 6. The rib frame portion 26*b* carries a flange 72 formed with a slot 74 therethrough. During longitudinal shifting of the deck stringer 22 from the position of FIG. 4 into that of FIG. 2, a resilient metal tongue 76 on the stringer 22 passes through the slot 74 and is locked in position by a latch 78 on the flange 72 entering a notch 80 in the tongue. The tongue 76 may released from the latch 78 manual pressure.

Figures 7, 8:
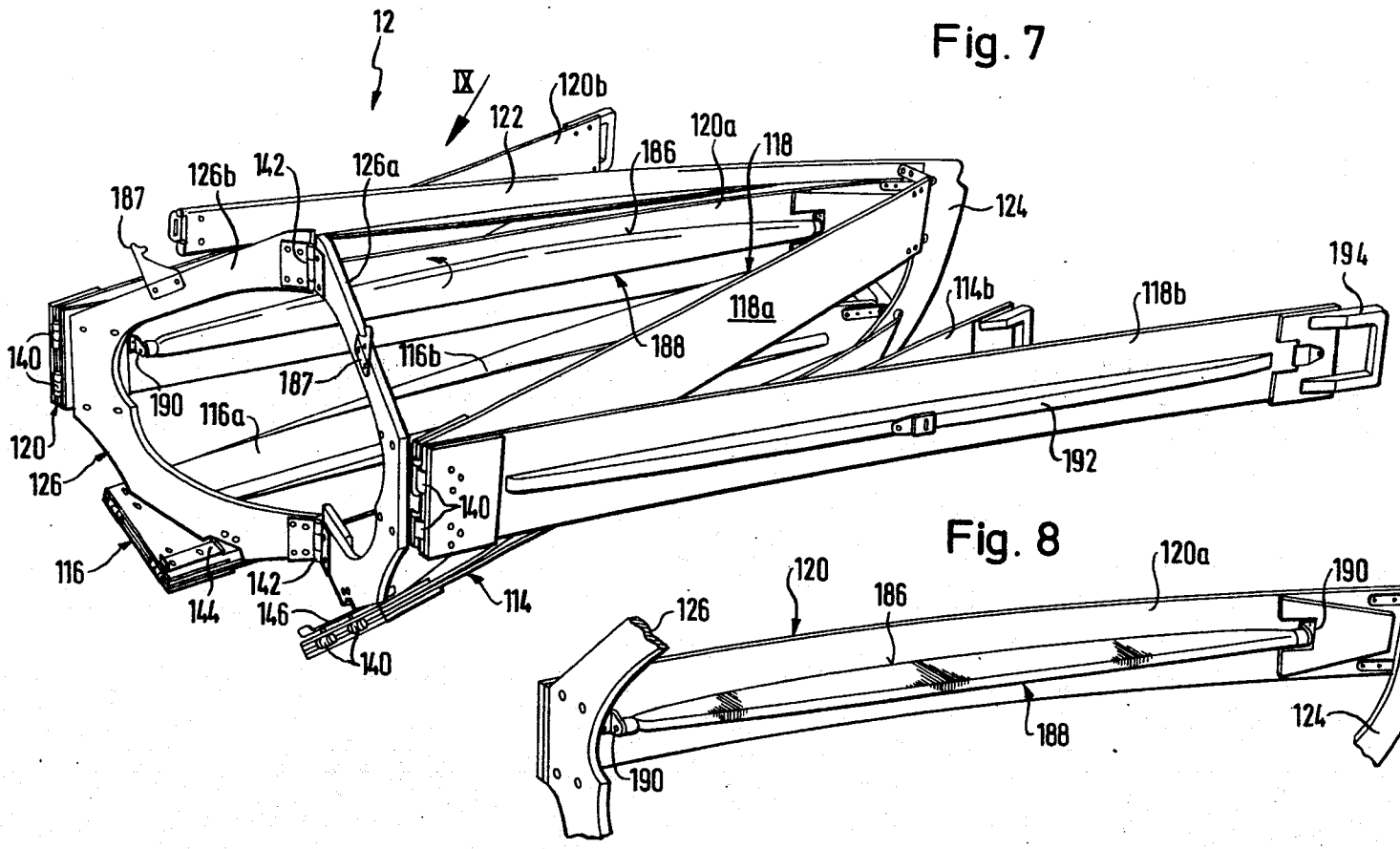
FIG. 7 illustrates the aft section of the frame in the almost completely collapsed condition in a perspective view.
FIG. 8 shows elements of the apparatus of FIG. 7 in the expanded condition.

The deck stringer 122 is not longer than the first portions of the bottom stringes 114, 116 and side stringers 118, 120 of the aft section 12 so as not to require a linkage corresponding to the linkage 38 nor a coupling assembly corresponding to the assembly 70. As is shown in FIG. 7, it is attached to the post 124 in the same manner as the stringer portions 114*a*, 116*a*, 118*a*, 120*a*, and to the rib frame 126 by a releasable hook and eye arrangement, not shown in detail.

The first portions 114*a*, 116*a* of the two bottom stringers 114, 116 are permanently attached to the halves 126*a*, 126*b* of the rib frame 126 by universal joint arrangements mounted on longitudinal guide rails 144, 146 on the bottom stringer portions 114*a*, 116*a* respectively. As is better seen in FIGS. 9 and 10, each guide rail 144, 146 carries a slide 148. One leaf 150 of a hinge 152 is attached to the slide 148 by a pivot pin 154 which is perpendicular to a major face of the associated bottom stringer portion 114*a*, 116*a*. The other hinge leaf 156 is attached to a rib frame half 126*a*, 126*b* by a hinge pin 155 perpendicular to the pin 154.

The universal joints carried by the slides 148 cause the major faces of the bottom stringer portions 114*a*, 116*a*, which converge toward the median plane of symmetry of the assembled aft-section 12 at an obtuse angle, to move angularly relative to each other to define a very small acute angle when the rib frame 126 is folded completely into its inoperative position, not specifically shown, in which the two halves are superimposed on each other, and the common pivot axis of the hinges 142 is in its position closest to the post 124.

The farthest position of the hinges 142 from the post 124 is reached in the fully expanded aft-section when lugs 143 on the rib frame half 126*a* abut against the half 126*b*, thereby preventing further pivotal movement after both halves have reached a common plane perpendicular to the longitudinal median plane. The axes of the pivot pins 141 in the hinges connecting the side stringer 118*a*, 120*a* to the rib frame 126 are always at least approximately parallel to the pivot axis of the hinges 142, and the major faces of the two side stringers 118, 120 are at least approximately parallel to each other in a section perpendicular to the direction of frame elongation.

Figure 9:
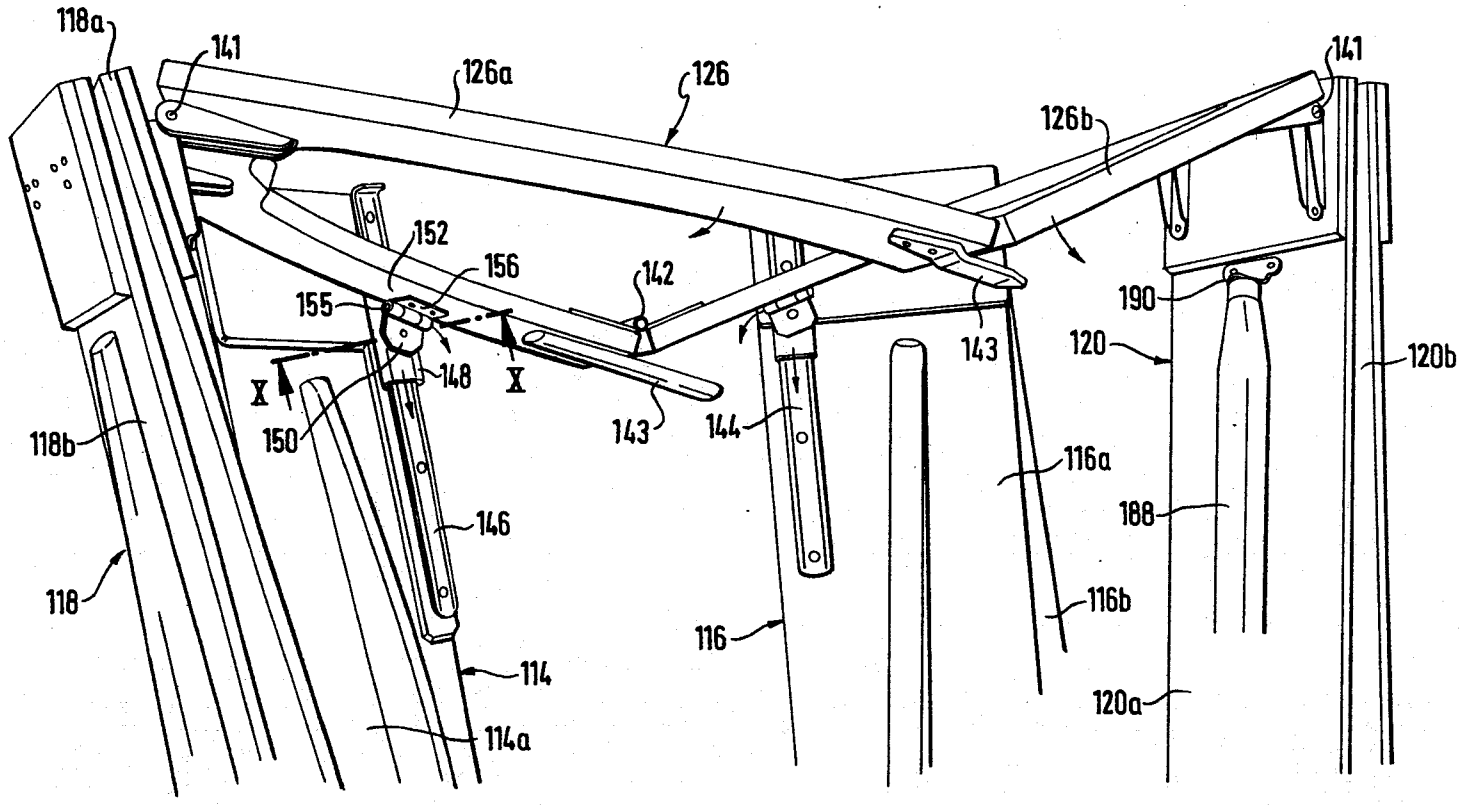
FIG. 9 illustrates elements of the apparatus of FIG. 7 in a perspective view in the direction of the arrow IX and on a larger scale.
Figure 10:
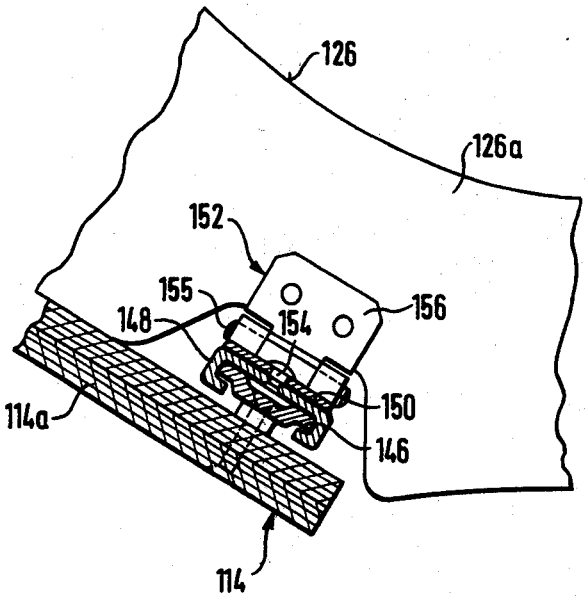
FIG. 10 shows a fragmentary section of the device of FIG. 9 taken on the line X — X.

FIGS. 7, 8, and 9 also show a backing segment 188 attached to the inner face of each first stringer portion 114*a*, 116*a*, 118*a*, 120*a* between bearing brackets 190. The segments 188 are rigid, flat tension bars having a convexly arcuate, longitudinal edge 186 which, when engaging the inner major face of the associated stringer, imparts a corresponding concave curvature to the inner face, whereby the outer face assumes a convexly arcuate shape desirable for reduced resistance of the water to the moving boat shell.

When the boat frame is collapsed, the arcuately flexed first side and bottom stringer portions would significantly increase the bulk of the frame package. When the segments 188 are turned 90° from the position of FIG. 8 into that of FIG. 9, the relaxing, resilient stringer portions 114*a*, 116*a*, 118*a*, 120*a* resume their normal, approximately planar configuration. The second stringer portions do not require strong flexing to give a streamlined contour to the boat shell, and thus may be backed by fixedly fastened shallow segments 192, as shown in FIG. 7 with respect to the stringer portion 118*b*.

Female portions 194 of the toggle couplings on the aft section 112 connecting the two frame sections in the assembled frame cooperate with male coupling portions 193 on the fore section 10 (FIG. 2) in a known manner. In all other respects, the bottom and side stringers of the aft section 12 described with reference to FIGS. 7 to 9 find their full equivalents in the corresponding stringers of the fore-section 10, and cooperate with the rib frame 26 in a manner entirely analogous to the operation of the rib frame 126.

After the fully expanded sections 10, 12 are inserted in the corresponding portions of the non-illustrated, pliable boat shell or skin, and coupled by the toggle couplings 193, 194, the deck sill 32 is attached to the deck stringer 22 by the fitting 84 and to the rib frame 126 in the aft-section 12 by means of hooks 187 (FIG. 7). The three loose ribs 28 are then placed in position between the bottom and side stringers and the sill, and seat plates 90 are laid on the bottom stringers.

Many of the advantages of this invention are available from boat frames differing in details from the illustrated embodiment. Thus, the guide rails 144, 146 may be mounted on the rib frame 126, and carry universal joints linking the slides with the bottom rails for the same angular displacement of the bottom rails during folding motion of the rib frame halves relative to each other. Other variations and permutations will readily suggest themselves to those skilled in the art.

It should be understood, therefore, that the foregoing disclosure relates only to a presently preferred embodiment of the invention, and that it is intended to cover all changes and modifications of the example of the invention herein chosen for the purpose of the disclosure which do not constitute departures from the spirit and scope of the appended claims.

What is claimed is:

1. A collapsible boat frame comprising a fore section and an aft section, each section being elongated and having a longitudinal median plane, each section including:

a. a post located in said plane;

b. two sets of elongated stringers extending away from said post on respective opposite sides of said plane, 1. each stringer of said sets having a first longitudinal portion movably attached to said post and a second portion hingedly attached to said first portion for movement toward and away from a folded position in which said portions are elongated in a common direction and are juxtaposed transversely to said common direction, 2. each set of stringers including a bottom stringer having a major longitudinal face on the first portion thereof;

c. a rib frame including two rib frame portions hingedly connected for movement about a pivot axis substantially parallel to said plane between an operative position in which said rib frame portions extend from said plane in opposite respective directions, and an inoperative position in which said rib frame portions are adjacent said plane;

d. a plurality of pivot means connecting said rib frame with said first stringer portions respectively for relative pivoting movement, 1. said pivot means including first and second pivot means connecting said rib frame portions to said first portions of said bottom stringers respectively, 2. said first and second pivot means including means for angularly moving the first bottom stringer portions relative to each other in response to movement of said rib frame portions between said operative and inoperative positions.

3. said major faces of said first bottom stringer portions converging toward said plane at a predetermined angle in said operative position of the rib frame portions, and at an angle smaller than said predetermined angle in said inoperative position of the rib frame portions; and e. coupling means on the second portion of each stringer for releasably coupling said second portion to the second portion of the corresponding stringer in the other section, the median planes of said sections substantially coinciding when the respective stringers thereof are coupled by said coupling means.

2. A boat frame as set forth in claim 1, wherein each set of stringers further includes a side stringer having a major longitudinal face approximately parallel to the corresponding face of the other side stringer in a section perpendicular to said plane.

3. A boat frame as set forth in claim 2, wherein said plurality of pivot means further includes third and fourth pivot means permanently connecting the first portions of said side stringers to said rib frame portions respectively for movement about respective axes substantially parallel to said median plane and fixedly spaced from said post, said first and second pivot means each including a universal joint mounted for translatory movement relative to one of the connected bottom stringer and rib frame portions.

4. A boat frame as set forth in claim 1, wherein said first and second pivot means each include a slide, guide means on the connected bottom stringer portion for guiding said slide longitudinally of said bottom stringer portion, a first hinge element mounted on said slide for angular movement about a first axis transverse to the direction of elongation of said bottom stringer portion, a second hinge element mounted on said connected rib frame portion, and hinge pin means connecting said hinge elements for relative movement about a second axis transverse to said first axis.

5. A boat frame as set forth in claim 4, wherein said pivot axis is nearer said post in the inoperative position of said rib frame portions than in the operative position thereof, said rib frame including abutment means on said rib frame portions engageable in said operative position for preventing movement of said pivot axis from said post.

6. A boat frame as set forth in claim 1, wherein each section further includes an elongated deck stringer permanently secured to said post and extending from said post toward said rib frame of the same section, said boat frame further comprising a deck sill, and securing means for securing said sill to said deck stringers.

7. A boat frame as set forth in claim 6, further comprising securing means connecting one of said deck stringers to the associated post for limited longitudinal movement.

8. A boat frame as set forth in claim 7, wherein said securing means include a link having respective portions mounted on said one deck stringer and said associated post for swinging movement about respective parallel axes, said deck stringer carrying fastening means spaced from said securing means for releasably fastening said deck stringer to the rib frame of said same section.

9. A boat frame as set forth in claim 8, wherein said post is plate-shaped and has two major faces substantially parallel to said plane, said securing means including another link having respective portions mounted on said one deck stringer and associated post for swinging movement about said respective parallel axes, said links being superposed on said major faces of said post respectively.

10. A boat frame as set forth in claim 8, wherein said securing means further include pivot means operatively interposed between said link and said deck stringer for pivoting movement of said deck stringer on said link about an axis transverse to said parallel axes.

11. A boat frame as set forth in claim 1, wherein at least the first portion of one stringer of each set is resiliently flexible, and backing means associated with said at least one stringer for backing the first portion of the associated stringer in a position in which said first portion extends from said post to said rib frame in an arc concave toward said plane, said first portion being substantially straight when in the relaxed condition.

12. A boat frame as set forth in claim 11, wherein said backing means include a backing member elongated in a common direction with said associated first stringer portion and fastened to the same for angular movement about a longitudinal axis, said backing member having a contact face defining a convex arc and engaging said associated first stringer portion in said position of the same.

* * * * *